US005732838A

United States Patent [19]

Young

[11] Patent Number: 5,732,838

[45] Date of Patent: Mar. 31, 1998

[54] PLASTIC BLOW MOLDED CONTAINER HAVING LOWER ANNULAR GRIP

[75] Inventor: William C. Young, Washtenaw County, Mich.

[73] Assignee: Plastipak Packaging, Inc., Plymouth, Mich.

[21] Appl. No.: 789,704

[22] Filed: Jan. 27, 1997

Related U.S. Application Data

[63] Continuation-in-part of Ser. No. 620,446, Mar. 22, 1996, abandoned.

[51] Int. Cl.[6] ..... B65D 1/02; B65D 23/10

[52] U.S. Cl. ..... 215/384; 215/375; 220/771

[58] Field of Search ..... 215/375, 384; 220/771, 675

[56] References Cited

U.S. PATENT DOCUMENTS

| | | | |
|---|---|---|---|
| D. 64,568 | 4/1924 | Schwenick | D9/538 |
| D. 123,235 | 10/1940 | Neuschaefer | D9/569 |
| D. 211,509 | 6/1968 | Vanderhyde | D9/538 |
| D. 214,425 | 6/1969 | Vanderhyde | D9/538 |
| D. 304,683 | 11/1989 | Hofer | D9/538 |
| D. 315,678 | 3/1991 | Darr | D9/392 |
| D. 322,562 | 12/1991 | Narsutis | D9/538 |
| 703,125 | 6/1902 | Emrich | 215/384 X |
| 2,893,678 | 7/1959 | Homan et al. | 215/384 |
| 3,537,498 | 11/1970 | Amand | 220/72 |
| 3,784,040 | 1/1974 | Douglas | 215/398 |
| 3,871,541 | 3/1975 | Adomaitis . | |
| 4,375,442 | 3/1983 | Ota et al. | 264/25 |
| 4,379,099 | 4/1983 | Ota et al. | 264/25 |
| 4,610,366 | 9/1986 | Estes et al. . | |
| 5,024,339 | 6/1991 | Riemer | 215/375 |
| 5,064,080 | 11/1991 | Young et al. | 215/375 |
| 5,139,162 | 8/1992 | Young et al. | 215/375 |
| 5,158,190 | 10/1992 | Sosenko | 215/384 |
| 5,217,128 | 6/1993 | Stenger | 220/671 X |
| 5,224,614 | 7/1993 | Bono et al. | 220/675 X |
| 5,287,978 | 2/1994 | Young et al. | 215/375 |
| 5,310,068 | 5/1994 | Saghri | 215/375 X |

*Primary Examiner*—Sue A. Weaver
*Attorney, Agent, or Firm*—Brooks & Kushman P.C.

[57] ABSTRACT

A plastic blow molded container (10) having an upper dispensing end (16), a lower base (18) and a body portion (20) extending therebetween is constructed with the body portion having a round upper drum section (36) and an inwardly extending lower annular grip section (38) having depressions (42) spaced about a central axis A of the container. Each depression (42) has a lower blunt end (44), an upper generally pointed end (46) and an intermediate portion (48) having sides (50) that taper toward each other in an upward direction. The lower location of the annular grip section (38) facilitates manual grasping of the bottle when initially grasped from a horizonal support surface while the tapering configuration of the depressions (42) facilitates manual fingertip gripping of the container by varying hand sizes. One embodiment has a lower base (18) with an annular support surface (62). Another embodiment has a lower base (18') including a central hub (66) connected to downwardly extending hollow legs (68) and curved ribs (70) that alternate with each other.

15 Claims, 5 Drawing Sheets

PLASTIC BLOW MOLDED CONTAINER HAVING LOWER ANNULAR GRIP

CROSS REFERENCE TO RELATED APPLICATION

This application is a continuation-in-part of prior application Ser. No. 08/620,446, now abandoned, which was filed on Mar. 22, 1996 by William C. Young under the title "Plastic Blow Molded Container Having Lower Annular Grip" and which is assigned to the assignee of the present application.

TECHNICAL FIELD

This invention relates to a plastic blow molded container that has a lower annular grip for facilitating handling of the bottle during dispensing of its contents.

BACKGROUND ART

Plastic blow molded containers have previously been provided with an inwardly extending grip that facilitates handling of the container during dispensing of its contents. The inwardly extending construction of the grip also provides a more rigid construction after the container is opened so that the gripping of the container can be maintained with less flexing. Usually such grips are located adjacent an upper portion of the container just below the upper dispensing end of the container, such as disclosed by United States Patents: U.S. Pat. Nos. Des. 315,678, Darr; 4,375,442, Ota et al.; 4,610,366, Estes et al.; and 5,224,614, Bono et al.

Other containers which have inwardly extending portions are disclosed by United States Patents: U.S. Pat. Nos. 3,537,498, Amand; 3,871,541, Adomaitis; and 4,379,099, Ota et al.

Plastic blow molded containers having a freestanding base including downwardly extending feet and curved ribs that alternate with each other about a central hub are disclosed by United States Patents: U.S. Pat. Nos. 5,064,080 Young et al; 5,139,162 Young et al; and 5,287,978 Young et al.

DISCLOSURE OF INVENTION

An object of the present invention is to provide an improved plastic blow molded container having an inwardly extending grip that facilitates handling of the container during dispensing of its contents.

In carrying out the above object, a plastic blow molded container constructed in accordance with the present invention includes a unitary plastic blow molding of a generally round construction having a central axis and including an upper dispensing end, a lower base and a body portion that extends between the upper dispensing end and the lower base. The upper dispensing end of the container includes a generally round shoulder that extends around the central axis and upwardly from the body portion in an inward direction toward the central axis. The upper dispensing end also includes a dispensing spout having an opening through which the contents of the container are filled and dispensed. The dispensing spout has a closure cap retainer for securing a closure cap that closes the container prior to dispensing of its contents. The lower base of the container extends downwardly from the body portion to close the container and has a lower extremity that supports the container on a horizontal support surface in an upright position. The lower base has an upper junction with the body portion at a height that is between 0.35 and 0.55 of the maximum diameter of the container. The body portion of the container includes a round upper drum section that extends downwardly from the upper dispensing end and also includes an inwardly extending lower annular grip that extends upwardly from the lower base and has a junction with the upper section at a height above the base lower extremity that is between 0.4 and 0.6 of the overall height of the container. The lower section has a plurality of inwardly extending depressions spaced around the central axis of the container. Each depression has a lower blunt end, an upper generally pointed end and an intermediate portion having sides that taper toward each other in an upward direction from its lower blunt end to its upper generally pointed end.

The lower location of the annular grip section facilitates the initial grasping of the container when it is picked up from a horizontal support surface since the grip is relatively close to the support surface. Furthermore, the upward tapering construction of the depressions of the annular grip section facilitates fingertip grasping of the container for children as well as adults with different hand sizes due to the varying size of the depressions along their heights.

In the preferred construction of the plastic blow molded container, the round upper drum section of the body portion has a height that is between 0.7 and 0.9 of the maximum diameter of the container. Furthermore, the inwardly extending lower annular grip section of the body portion has a height that is between 0.9 and 1.1 of the maximum diameter of the container. Thus, the round upper drum section of the body portion has a height that is between 0.7 and 0.9 of the maximum diameter of the container as well as the inwardly extending lower annular grip section of the body portion having a height that is between 0.9 and 1.1 of the maximum diameter of the container.

In the preferred construction of the plastic blow molded container, the inwardly extending lower annular grip section of the body portion has upper and lower extremities that define the maximum diameter of the container, and the inwardly extending lower section has an intermediate portion that defines the minimum diameter of the container which is between 0.75 and 0.9 of the maximum diameter of the container. This intermediate portion of the lower annular grip section of the body portion preferably has the minimum diameter thereof located above the lower extremity thereof at a height that is between 0.65 and 0.8 of the overall height of the lower section. The minimum diameter of the lower annular grip section of the body portion is between 0.75 and 0.9 of the maximum diameter of the container.

In its preferred construction, the plastic blow molded container also has its upper dispensing end provided with depressions spaced around the central axis on its shoulder.

In one embodiment, the lower base of the plastic blow molded container has an annular support surface that defines its lower extremity for supporting the container and also has a central dome that extends upwardly from the annular support surface. This central dome of the lower base includes ribs that are spaced around the central axis and extend radially in an outward direction from the central axis. Thus, this embodiment has the upper dispensing end provided with depressions spaced around the central axis on its shoulder as well as having the lower base provided with an annular support surface that defines its lower extremity for supporting the container and also having a central dome that extends upwardly from the annular support surface and including ribs that are spaced around the central axis and extend radially in an outward direction from the central axis.

In another embodiment capable of withstanding internal pressure, the lower base includes a central hub and a plurality of downwardly projecting legs that extend between the central hub and the body portion. In addition, a plurality of curved ribs extend between the central hub and the body portion in this embodiment in an alternating relationship with the legs. Each leg has an outer curved wall having a radius of curvature that is greater than 0.75 of the maximum diameter of the container. Furthermore, each rib has a radius of curvature that is greater than 0.6 of the maximum diameter of the container and that is located on the opposite side of the central axis from the rib.

The objects, features and advantages of the present invention are readily apparent from the following detailed description of the best modes for carrying out the invention when taken in connection with the accompanying drawings.

BEST MODES FOR CARRYING OUT THE INVENTION

Figure 1:
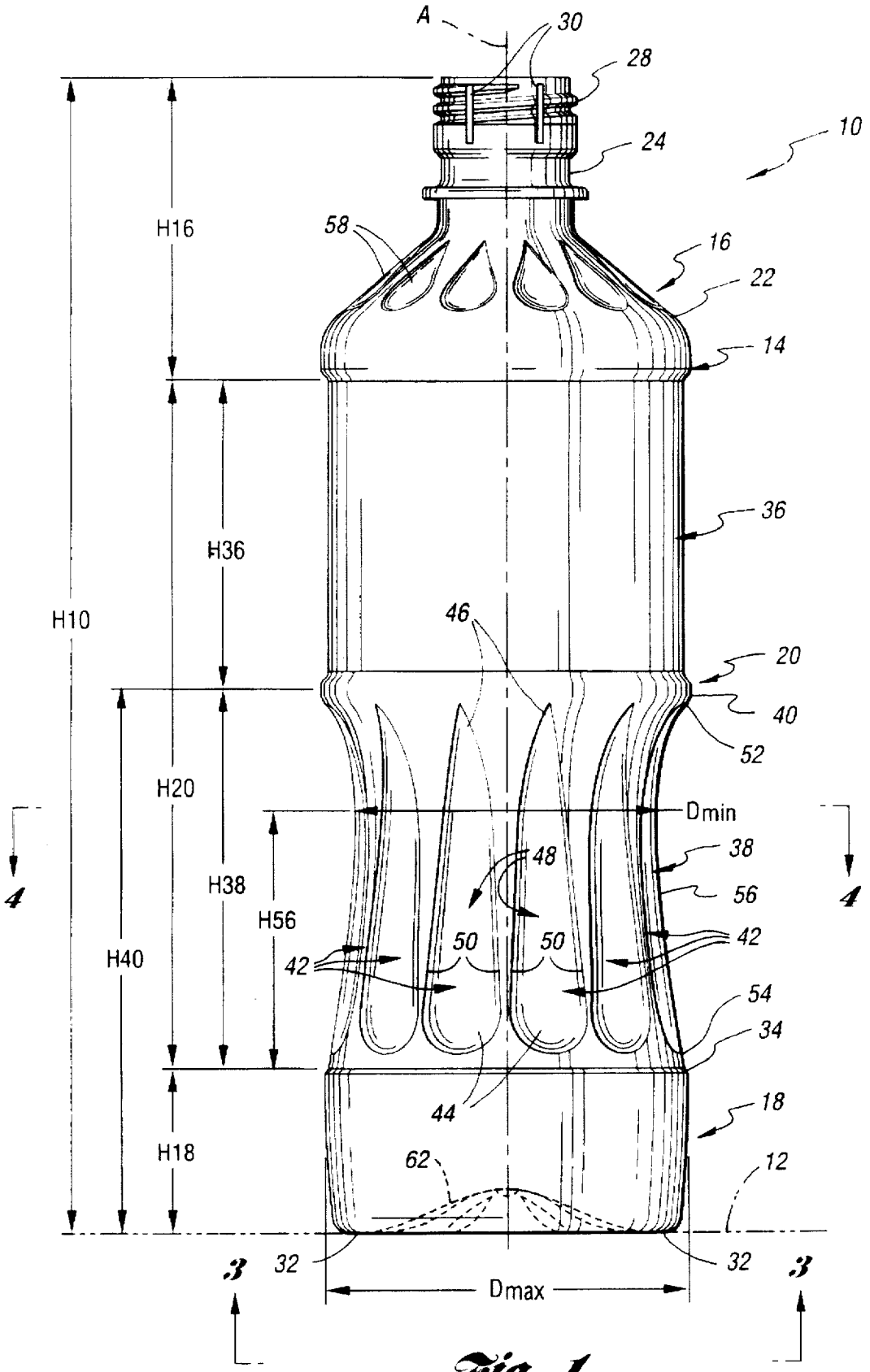
FIG. 1 is an elevational view of a plastic blow molded container that is constructed in accordance with the present invention with a lower annular grip section.

With reference to FIG. 1 of the drawings, a plastic blow molded container generally indicated by 10 is shown setting on a horizontal support surface 12 in an upright position. This container 10 is constructed as a unitary plastic blow molding 14 from a suitable resin such as polyethylene terephthalate. The process utilized to perform the blow molding is preferably performed by injection molding a preform which is cooled and then reheated during the blow molding during which the preform is also axially stretched to provide biaxial orientation that strengthens the resultant container after the blow molding is completed. The blow molding 14, and the container 10 as well, has a generally round construction with a central axis A and includes an upper dispensing end 16, a lower base 18 and a body portion 20 that extends between the upper dispensing end and the lower base. The container 10 has an overall height $H_{10}$, which is the total of the height $H_{16}$ of the upper dispensing end 16, the height $H_{18}$ of the lower base 18 and the height $H_{20}$ of the body portion 20. Furthermore, the container 10 has a generally round shape with a maximum diameter $D_{max}$ and a minimum diameter $D_{min}$ as is hereinafter more fully described.

The upper dispensing end 16 of the container 10 has its height $H_{16}$ between 0.65 and 0.85 of the maximum diameter $D_{max}$ of the container, while the lower base 18 has its height $H_{18}$ between 0.35 and 0.55 of the maximum diameter $D_{max}$ of the container and the body portion 20 has its height $H_{20}$ between 1.8 and 2.2 times the maximum diameter $D_{max}$ of the container. The container 10 has its overall height $H_{10}$ between 3.0 and 3.3 times its maximum diameter $D_{max}$.

Figure 2:
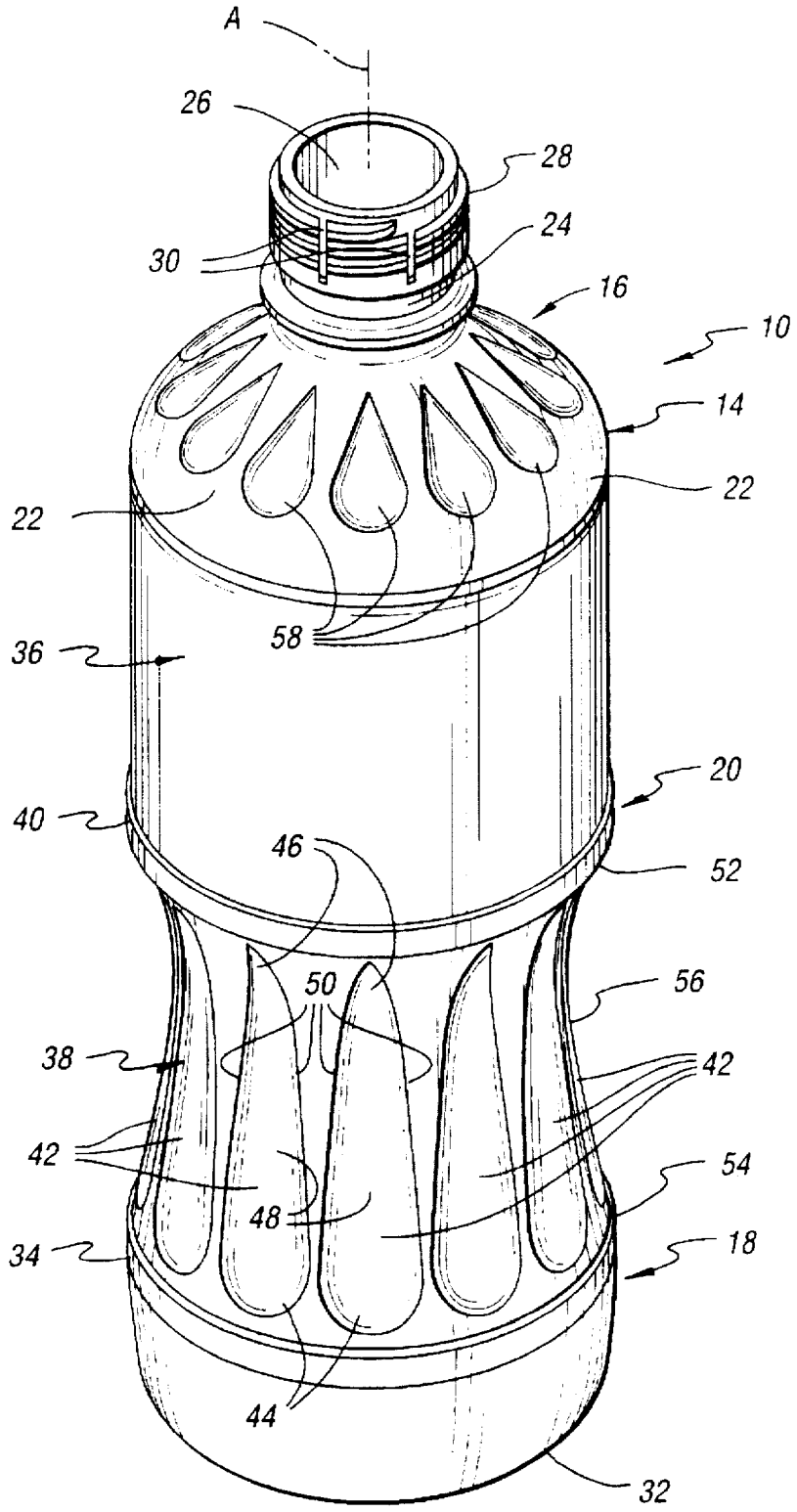
FIG. 2 is a perspective view of the container taken from an upward position to one side thereof to further illustrate the container construction.

With continuing reference to FIG. 1 and also to FIG. 2, the upper dispensing end 16 includes a generally round shoulder 22 that extends around the central axis A and upwardly from the body portion 20 in an inward direction toward the central axis A. This upper dispensing end 16 also includes a dispensing spout 24 having an opening 26 through which contents of the container are filled and dispensed. Dispensing spout 24 has a closure cap retainer 28 that is illustrated as a helical thread with axial cuts 30 that facilitate gas pressure release as the container is initially opening upon unscrewing of an unshown closure cap.

Lower base 18 of the container 10 extends downwardly as shown in FIGS. 1 and 2 from the body portion 20 to close the container and has a lower extremity 32 that supports the container as shown in FIG. 1 on the horizontal support surface 12 in the upright position illustrated. The lower base has an upper junction 34 with the lower extremity of the body portion 20 at the height $H_{18}$ previously mentioned between 0.35 and 0.45 of the maximum diameter $D_{max}$ of the container.

As illustrated by continuing reference to FIGS. 1 and 2, the body portion 20 of the container 10 includes a round upper drum section 36 that extends downwardly from the upper dispensing end 16 and also includes an inwardly extending lower annular grip section 38 that extends upwardly from the lower base 18 and has a junction 40 of an annular shape with the upper section 36. This junction 40, like the lower extremity of the upper dispensing end 16 and like the upper extremity of the lower base 18, has a diameter that is equal to the maximum diameter $D_{max}$ of the container. Furthermore, the junction 40 has a height $H_{40}$ that is between 0.4 and 0.6 of the overall height $H_{10}$ of the container.

Figure 4:
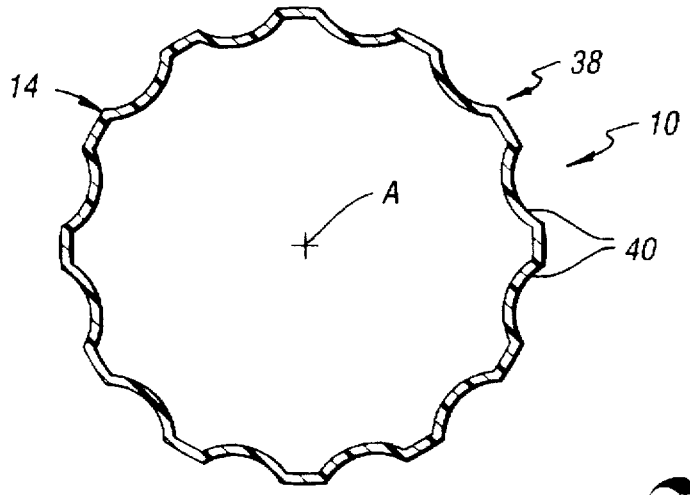
FIG. 4 is a sectional view of the container taken along the direction of line 4—4 in FIG. 1 to further illustrate the construction of the annular grip section of the container.

As illustrated in FIGS. 1, 2 and 4, the lower annular grip section 38 of the body portion has a plurality of inwardly extending depressions 42 spaced circumferentially about the central axis A of the container. More specifically, there are twelve of the depressions as illustrated and each as illustrated in FIG. 4 has a curved shape when viewed in a vertical section as shown. Each depression 40 of the lower section 38, as shown in FIGS. 1 and 2, has a lower blunt end 44, an upper generally pointed end 46 and an intermediate portion 48 having sides 50 that taper toward each other in an upward direction from its lower blunt end to its upper generally pointed end.

The construction of the container 10 as illustrated with the lower grip section 38 relatively close to the lower extremity of the lower base 18 facilitates manual grasping and picking up of the container from a horizontal support surface. Furthermore, the construction of the depressions 42 with the upwardly tapering shape facilitates fingertip grasping for children and adults with varying hand sizes.

In the preferred construction of the container 10, both the upper drum section 36 and the lower annular grip section 38 have sizes that are proportioned with respect to the maximum diameter $D_{max}$ of the container. More specifically, the round upper drum section 36 of the body portion 20 has a height $H_{36}$ that is between 0.7 and 0.9 of the maximum diameter of the container, while the inwardly extending lower annular grip section 38 of the body portion 20 has a height $H_{38}$ that is between 0.9 and 1.1 of the maximum diameter of the container.

With continuing reference to FIG. 1, the inwardly extending lower annular grip section 38 of the body portion 20 has upper and lower extremities 52 and 54, respectively, at the junction 40 with the upper drum section 36 and the junction 34 with the lower base 18. In addition, the inwardly extending lower section 38 has an intermediate portion 56 that extends between the upper and lower extremities 52 and 54 and defines the minimum diameter $D_{min}$ of the container which is between 0.75 and 0.9 of the maximum diameter of the container. The intermediate portion 56 of the lower annular grip section of the body portion 20 has this minimum diameter $D_{min}$ thereof located at a height $H_{56}$ that is between 0.65 and 0.8 of the overall height $H_{36}$ of the lower section 38. From its minimum diameter $D_{min}$ at the height $H_{56}$, the intermediate portion 56 of the lower annular grip section 38 curves downwardly to the lower base junction 34 with a much more gentle curvature than the upward curvature outwardly to the junction 40 with the upper drum section 36. Furthermore, the minimum diameter $D_{min}$ of the lower annular grip section 38 of the body portion 20 is between 0.75 and 0.9 of the maximum diameter $D_{max}$ of the container.

As illustrated in FIGS. 1 and 2, the preferred construction of the container 10 has its upper dispensing end 16 provided with depressions 58 spaced around the central axis A on its shoulder 22. There are twelve of the depressions 58 as illustrated equally spaced from each other with teardrop shapes that have a much smaller height to width ratio than the shapes of the depressions 42 of the lower annular grip 38 as previously described.

Figure 3:
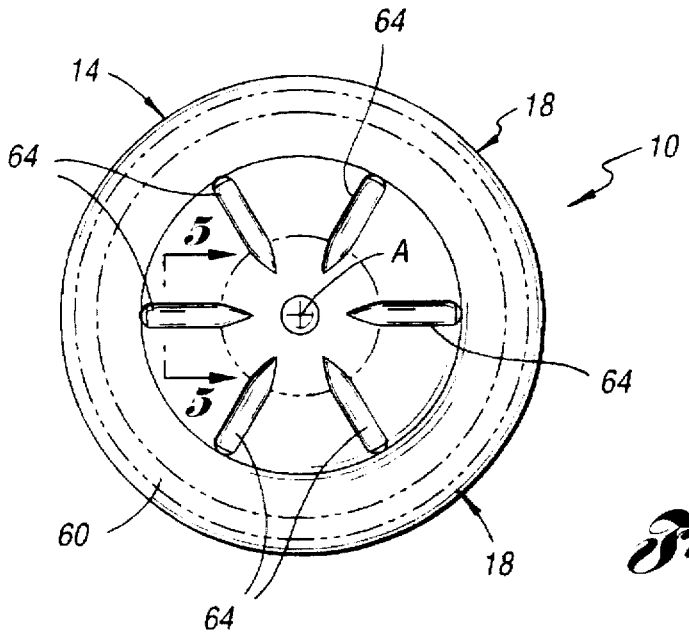
FIG. 3 is a bottom plan view of the container taken along the direction of line 3—3 in FIG. 1 to illustrate the construction of a lower base of the container.
Figure 5:
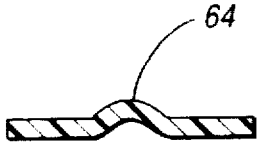
FIG. 5 is a partial sectional view taken along the direction of line 5—5 in FIG. 3 to illustrate a rib construction of the lower base.

As illustrated by combined reference to FIGS. 1 and 3, the container 10 has the lower base 18 provided with an annular surface 60 that defines its lower extremity 32 shown in FIG. 1 for supporting the container in the upright position illustrated on the support surface. The lower base 18 also has a central dome 62 that extends upwardly as illustrated in FIG. 1 from the annular support surface 60 (FIG. 3) at the lower container extremity 32 (FIG. 1), with the center of the central dome located along the central axis A of the container. This central dome 62, as shown in FIGS. 3 and 5, has ribs 64 that are spaced around the central axis A and extend radially in an outward direction from the central axis. More specifically, as illustrated, there are six of the ribs 64 spaced at 60° intervals from each other about the central axis A and each rib 64 has an upwardly extending shape as illustrated in FIG. 5.

Figure 6:
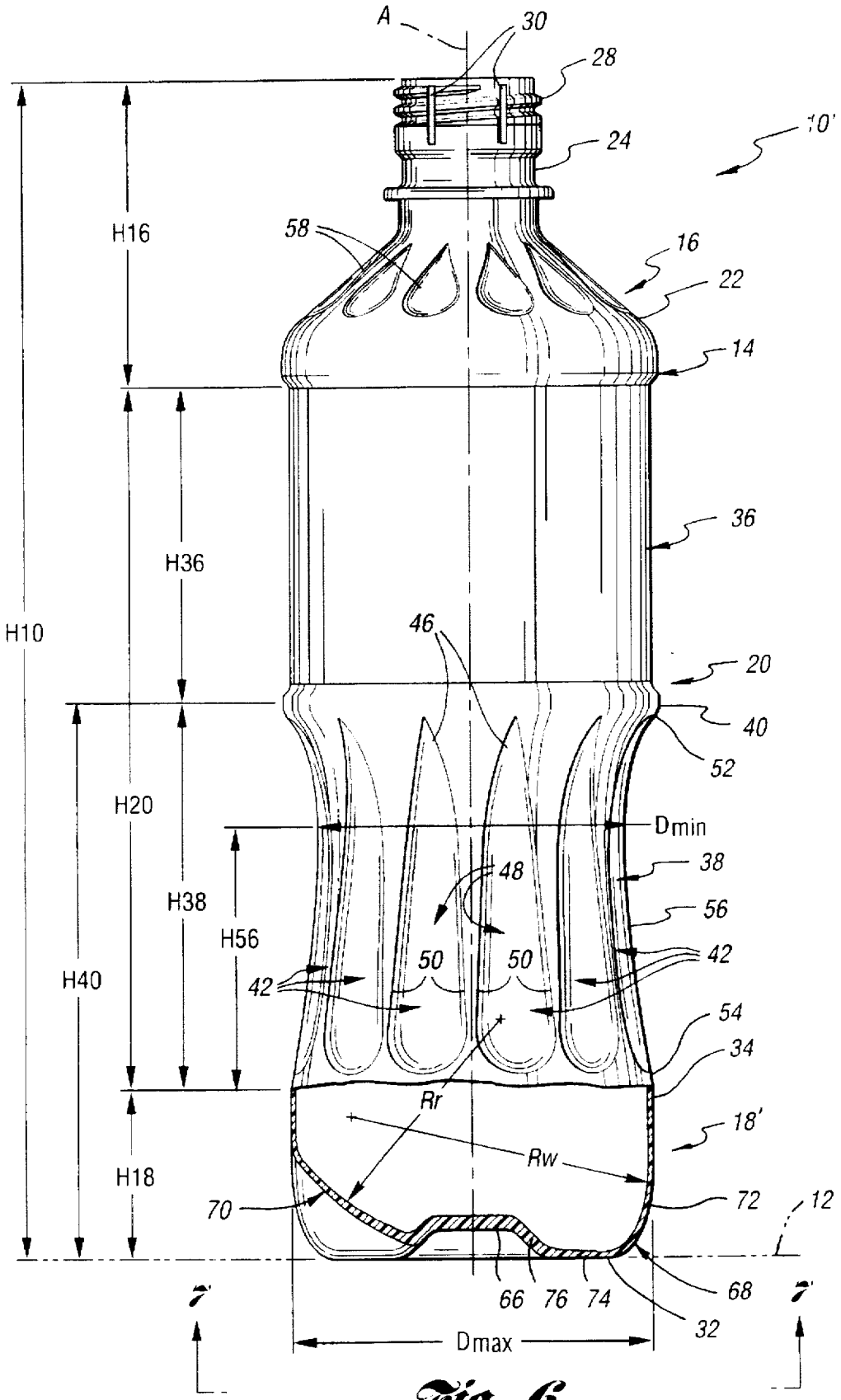
FIG. 6 is an elevational view of another embodiment of a plastic blow molded container that is constructed in accordance with the present invention with a lower annular grip section but having a different lower base structure than the embodiment of FIGS. 1–5.

With reference to FIG. 6, another embodiment of the container 10' has a construction that is generally the same as the embodiment of FIGS. 1–5 except as will be noted such that like reference numerals are applied to like components thereof and much of the previous description is applicable such that it will not be repeated. However, this embodiment of the container 10' has a lower base 18' of a different construction that is capable of withstanding internal pressure such as is necessary with carbonated beverages.

Figure 7:
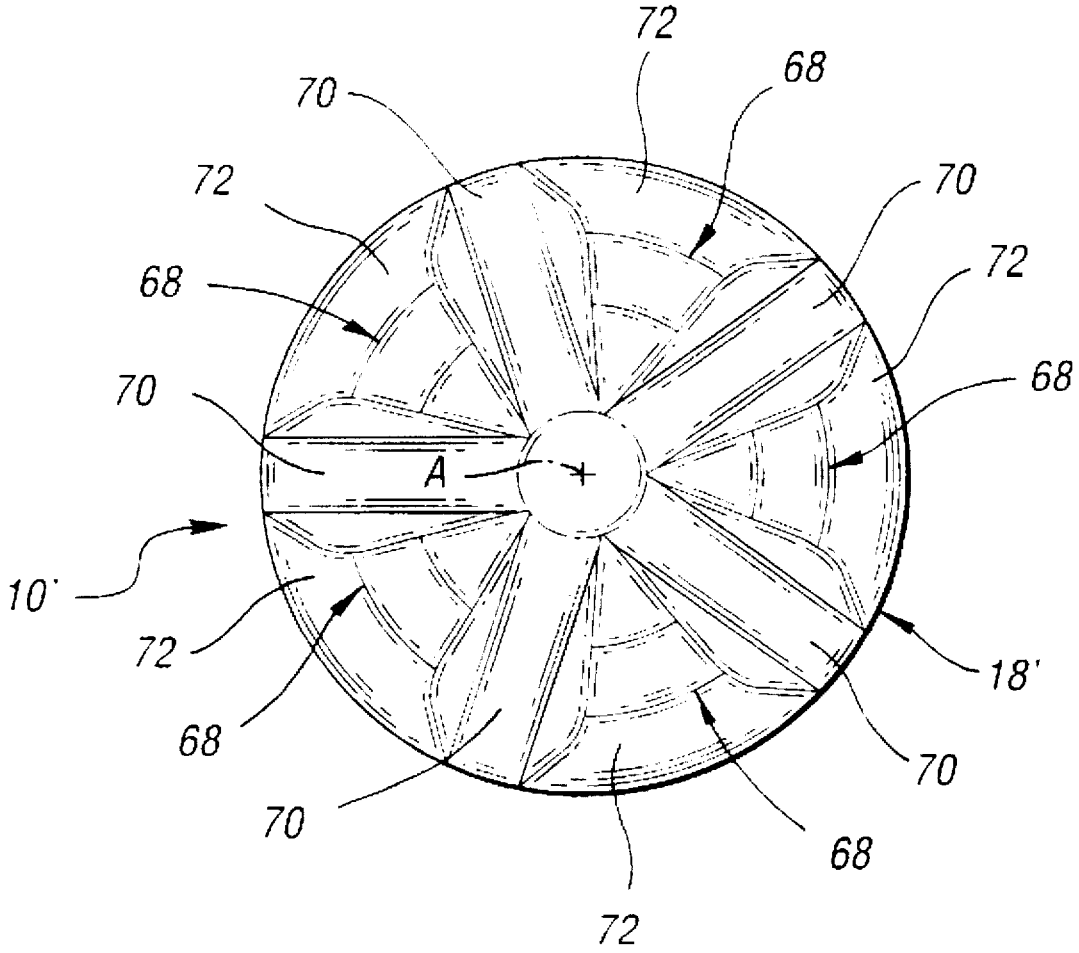
FIG. 7 is a bottom plan view taken along the direction of line 7—7 in FIG. 6 to further illustrate the construction of the base of this further embodiment.

With reference to both FIGS. 6 and 7, the lower base 18' has a freestanding construction including a central hub 66 through which the central axis A of the blow molding 14 and the container 10' extends. The lower base 18' also includes a plurality of downwardly projecting legs 68 of a hollow construction that extend between the central hub 66 and the body portion 20 at the lower extremity 54 of the lower annular grip section 38. As specifically illustrated in FIG. 7, there are five of such downwardly extending legs 68. Furthermore, the lower base 18' also includes a plurality of curved ribs 70 that extend between the central hub 66 and the body portion 20 at the lower extremity 54 of the lower annular grip section 38. The curved ribs 70 of the lower base 18' are in an alternating relationship with the legs 68. Thus, as illustrated, there are five of the curved ribs 70 as well as five of the legs 68.

As illustrated in FIG. 6, each leg 68 includes an outer curved wall 72 having a radius of curvature $R_w$ that is greater than 0.75 of the maximum diameter $D_{max}$ of the container 10' and blow molding More specifically, this outer curved wall merges in a tangential relationship with the lower extremity 54 of the lower annular grip section 38 at the upper extremity of the lower base 18'. Each leg 68 also has a lower flat foot 74 whose outer extremity is connected by a curved junction with the lower extremity of the outer curved wall 72 by a curved junction and whose inner extremity is connected to a connecting portion 76 that extends upwardly in an inclined orientation to the central hub 66. The central hub 66, the connecting portion 76 and the foot 74 have a much greater wall thickness than the rest of the container since there is less stretching thereof during the blow molding such that these parts of the container are relatively unoriented compared to the rest of the container.

With continuing reference to FIG. 6, each curved rib 70 has a radius of curvature that is greater than 0.6 of the maximum diameter $D_{max}$ of the container 10' and blow molding 14. Furthermore, the center of the radius of curvature $R_r$ is located on the opposite side of the central axis A from the rib 70. It should also be noted that the inner portion of each curved rib 70 has a greater wall thickness than the outer portion thereof since there is less stretching thereof during the blow molding such that the inner portion is relatively unoriented compared to the rest of the container. In this regard, it should be mentioned that the curved ribs which carry force that allows the lower base 18' to withstand internal pressure may have lower inner ends that are of a greater cross-sectional width than the upper outer ends thereof so that there is a greater amount of material, where the container wall is unoriented and of lesser strength, for providing connection of the curved ribs to the hub 66 with a construction thus strengthens the lower base portion.

While the best modes for carrying out the invention have been described in detail, those familiar with the art to which this invention relates will recognize various alternative designs and embodiments for practicing the invention as defined by the following claims.

What is claimed is:

1. A plastic blow molded container of a generally round construction having a central axis, comprising:

a unitary plastic blow molding of a generally round construction having a central axis that is coincident with the central axis of the container and including an upper dispensing end, a lower base and a body portion that extends between the upper dispensing end and the lower base;

the upper dispensing end including a generally round shoulder that extends around the central axis and upwardly from the body portion in an inward direction toward the central axis, the upper dispensing end also including a dispensing spout having an opening through which contents of the container are filled and dispensed, and the dispensing spout having a closure cap retainer;

the lower base extending downwardly from the body portion to close the container and having a lower extremity that supports the container on a horizontal support surface in an upright position, and the lower base having an upper junction with the body portion at a height that is between 0.35 and 0.55 of the maximum diameter of the container; and the body portion including a round upper drum section that extends downwardly from the upper dispensing end and also including an inwardly extending lower annular grip section that extends upwardly from the lower base and has a junction with the upper section at a height above the base lower extremity that is between 0.4 and 0.6 of the overall height of the container, the lower section having a plurality of inwardly extending depressions spaced about the central axis of the container, and each depression having a lower blunt end, an upper generally pointed end and an intermediate portion having sides that taper toward each other in an upward direction from its lower blunt end to its upper generally pointed end.

2. A plastic blow molded container as in claim 1 wherein the round upper drum section of the body portion has a height that is between 0.7 and 0.9 of the maximum diameter of the container.

3. A plastic blow molded container as in claim 1 wherein the inwardly extending lower annular grip section of the body portion has a height that is between 0.9 and 1.1 of the maximum diameter of the container.

4. A plastic blow molded container as in claim 1 wherein the round upper drum section of the body portion has a height that is between 0.7 and 0.9 of the maximum diameter of the container, and the inwardly extending lower annular grip section of the body portion having a height that is between 0.9 and 1.1 of the maximum diameter of the container.

5. A plastic blow molded container as in claim 1 wherein the inwardly extending lower annular grip section of the body portion has upper and lower extremities that define the maximum diameter of the container, and the inwardly extending lower section having an intermediate portion that defines the minimum diameter of the container which is between 0.75 and 0.9 of the maximum diameter of the container.

6. A plastic blow molded container as in claim 5 wherein the intermediate portion of the lower annular grip section of the body portion has the minimum diameter thereof located above the lower extremity thereof at a height that is between 0.65 and 0.8 of the overall height of the lower section.

7. A plastic blow molded container as in claim 1 wherein the minimum diameter of the lower annular grip section of the body portion is between 0.75 and 0.9 of the maximum diameter of the container.

8. A plastic blow molded container as in claim 1 wherein the upper dispensing end includes depressions spaced around the central axis on its shoulder.

9. A plastic blow molded container as in claim 1 wherein the lower base has an annular support surface that defines its lower extremity for supporting the container and also has a central dome that extends upwardly from the annular support surface, and the central dome including ribs that are spaced around the central axis and extend radially in an outward direction from the central axis.

10. A plastic blow molded container as in claim 1 wherein the upper dispensing end includes depressions spaced around the central axis on its shoulder, the lower base having an annular support surface that defines its lower extremity for supporting the container and also has a central dome that extends upwardly from the annular support surface, and the central dome including ribs that are spaced around the central axis and extend radially in an outward direction from the central axis.

11. A plastic blow molded container as in claim 1 wherein the lower base includes a central hub, a plurality of downwardly projecting legs that extend between the central hub and the body portion, and a plurality of curved ribs that extend between the central hub and the body portion in an alternating relationship with the legs.

12. A plastic blow molded container as in claim 11 wherein each leg includes an outer curved wall having a radius of curvature that is greater than 0.75 of the maximum diameter of the coatainer, and each rib having a radius of curvature that is greater than 0.6 of the maximum diameter of the container.

13. A plastic blow molded container of a generally round construction having a central axis, comprising:

a unitary plastic blow molding of a generally round construction having a central axis that is coincident with the central axis of the container and including an upper dispensing end, a lower base and a body portion that extends between the upper dispensing end and the lower base;

the upper dispensing end including a generally round shoulder that extends around the central axis and upwardly from the body portion in an inward direction toward the central axis, the upper dispensing end also including a dispensing spout having an opening through which contents of the container are filled and dispensed, and the dispensing spout having a closure cap retainer;

the lower base extending downwardly from the body portion to close the container and having a lower extremity that supports the container on a horizontal support surface in an upright position, and the lower base having an upper junction with the body portion at a height that is between 0.35 and 0.55 of the maximum diameter of the container; and the body portion including a round upper drum section that extends downwardly from the upper dispensing end and having a height that is between 0.7 and 0.9 of the maximum diameter of the container, the body portion also including an inwardly extending lower annular grip section that extends upwardly from the lower base and has a junction with the upper section at a height above the base lower extremity that is between 0.4 and 0.6 of the overall height of the container, the lower section having a height that is between 0.9 and 1.1 of the maximum diameter of the container, the minimum diameter of the lower section being between 0.75 and 0.9 of the maximum diameter of the container, the lower section including a plurality of inwardly extending depressions spaced about the central axis of the container, and each depression having a lower blunt end, an upper generally pointed end and an intermediate portion having sides that taper toward each other in an upward direction from its lower blunt end to its upper generally pointed end.

14. A plastic blow molded container of a generally round construction having a central axis, comprising:

a unitary plastic blow molding of a generally round construction having a central axis that is coincident with the central axis of the container and including an upper dispensing end, a lower base and a body portion that extends between the upper dispensing end and the lower base;

the upper dispensing end including a generally round shoulder that extends around the central axis and upwardly from the body portion in an inward direction toward the central axis, the upper dispensing end also including a dispensing spout having an opening through which contents of the container are filled and dispensed, the dispensing spout having a closure cap retainer, and the upper dispensing end including depressions spaced around the central axis on its shoulder;

the lower base extending downwardly from the body portion to close the container and having a lower extremity that supports the container on a horizontal support surface in an upright position, the lower base having an upper junction with the body portion at a height that is between 0.35 and 0.55 of the maximum diameter of the container, the lower base having an annular support surface that defines its lower extremity for supporting the container and also having a central dome that extends upwardly from the annular support surface, and the central dome including ribs that are spaced around the central axis and extend radially in an outward direction from the central axis; and the body portion including a round upper drum section that extends downwardly from the upper dispensing end and having a height that is between 0.7 and 0.9 of the maximum diameter of the container, the body portion of the container also including an inwardly extending lower annular grip section that extends upwardly from the lower base and has a junction with the upper section at a height above the base lower extremity that is between 0.4 and 0.6 of the overall height of the container, the lower section having a height that is between 0.9 and 1.1 of the maximum diameter of the container, the lower section of the body portion having upper and lower extremities that define the maximum diameter of the container, the lower section having an intermediate portion that defines the minimum diameter of the container which is between 0.75 and 0.9 of the maximum diameter of the container, the minimum diameter of the lower section being located above the lower extremity thereof at a height that is between 0.65 and the lower section including a plurality of inwardly extending depressions spaced about the central axis of the container, and each depression having a lower blunt end, an upper generally pointed end and an intermediate portion having sides that taper toward each other in an upward direction from its lower blunt end to its upper generally pointed end.

15. A plastic blow molded container of a generally round construction having a central axis, comprising:

a unitary plastic blow molding of a generally round construction having a central axis that is coincident with the central axis of the container and including an upper dispensing end, a lower base and a body portion that extends between the upper dispensing end and the lower base;

the upper dispensing end including a generally round shoulder that extends around the central axis and upwardly from the body portion in an inward direction toward the central axis, the upper dispensing end also including a dispensing spout having an opening through which contents of the container are filled and dispensed, the dispensing spout having a closure cap retainer, and the upper dispensing end including depressions spaced around the central axis on its shoulder;

the lower base extending downwardly from the body portion to close the container and having a lower extremity that supports the container on a horizontal support surface in an upright position, the lower base having an upper junction with the body portion at a height that is between 0.35 and 0.55 of the maximum diameter of the container, the lower base having a central hub and a plurality of downwardly projecting legs that extend between the central hub and the body portion, the lower base also having a plurality of curved ribs that extend between the central hub and the body portion in an alternating relationship with the legs, each leg including an outer curved wall having a radius of curvature that is greater than 0.75 of the maximum diameter of the container, and each rib having a radius of curvature that is greater than 0.6 of the maximum diameter of the container and whose center is located on the opposite side of the central axis from the rib; and the body portion including a round upper drum section that extends downwardly from the upper dispensing end and having a height that is between 0.7 and 0.9 of the maximum diameter of the container, the body portion of the container also including an inwardly extending lower annular grip section that extends upwardly from the lower base and has a junction with the upper section at a height above the base lower extremity that is between 0.4 and 0.6 of the overall height of the container, the lower section having a height that is between 0.9 and 1.1 of the maximum diameter of the container, the lower section of the body portion having upper and lower extremities that define the maximum diameter of the container, the lower section having an intermediate portion that defines the minimum diameter of the container which is between 0.75 and 0.9 of the maximum diameter of the container, the minimum diameter of the lower section being located above the lower extremity thereof at a height that is between 0.65 and 0.8 of the overall height of the lower section, the lower section including a plurality of inwardly extending depressions spaced about the central axis of the container, and each depression having a lower blunt end, an upper generally pointed end and an intermediate portion having sides that taper toward each other in an upward direction from its lower blunt end to its upper generally pointed end.

* * * * *

UNITED STATES PATENT AND TRADEMARK OFFICE

CERTIFICATE OF CORRECTION

PATENT NO. : 5,732,838

DATED : March 31, 1998

INVENTOR(S) : William C. Young

It is certified that error appears in the above-identified patent and that said Letters Patent is hereby corrected as shown below:

Column 8, Line 13, Claim 12, "coatainer" should be --container--.

Signed and Sealed this

Twenty-second Day of December, 1998

Bruce Lehman

*Attest:*

BRUCE LEHMAN

*Attesting Officer*

*Commissioner of Patents and Trademarks*